US008534220B1

(12) United States Patent
Olson

(10) Patent No.: US 8,534,220 B1
(45) Date of Patent: Sep. 17, 2013

(54) DOSAGE CAP ASSEMBLY FOR STANDARD PRESCRIPTION MEDICINE CONTAINERS

(76) Inventor: Edwin W. Olson, West Columbia, TX (US)

( * ) Notice: Subject to any disclaimer, the term of this patent is extended or adjusted under 35 U.S.C. 154(b) by 344 days.

(21) Appl. No.: 12/786,092

(22) Filed: May 24, 2010

Related U.S. Application Data

(60) Provisional application No. 61/258,724, filed on Nov. 6, 2009.

(51) Int. Cl.
*G09F 11/23* (2006.01)

(52) U.S. Cl.
USPC ..... 116/309; 116/308; 215/230

(58) Field of Classification Search
CPC ..... G09F 11/23
USPC ..... 116/201, 308, 309, 311, 316, 319, 116/320; 368/10, 107–109; 206/534; 215/230, 215/217, 219, 220; D7/629; D3/323
See application file for complete search history.

(56) References Cited

U.S. PATENT DOCUMENTS

| | | | | | |
|---|---|---|---|---|---|
| 303,958 | A | * | 8/1884 | Vaughan | 224/582 |
| 620,013 | A | * | 2/1899 | Barnes | 312/209 |
| 692,166 | A | * | 1/1902 | Schaffer | 116/308 |
| 2,450,949 | A | * | 10/1948 | Gattuccio et al. | 116/308 |
| 2,587,147 | A | * | 2/1952 | Guion et al. | 116/308 |
| 2,706,464 | A | * | 4/1955 | North | 116/308 |
| 2,767,680 | A | | 10/1956 | Lermer | |
| 3,627,122 | A | * | 12/1971 | Garbe, Jr. | 206/571 |
| 3,762,601 | A | * | 10/1973 | McLaughlin | 221/2 |
| 3,766,882 | A | | 10/1973 | Babbitt, III et al. | |
| 4,207,982 | A | * | 6/1980 | Maxwell et al. | 206/534 |
| 4,238,033 | A | | 12/1980 | Artzt | |
| 4,365,722 | A | * | 12/1982 | Kramer | 215/220 |
| 4,389,963 | A | * | 6/1983 | Pearson | 116/308 |
| 4,405,045 | A | * | 9/1983 | Villa-Real | 206/534 |
| 4,432,300 | A | * | 2/1984 | Lyss | 116/308 |
| 4,440,306 | A | * | 4/1984 | Van Buskirk et al. | 215/230 |
| 4,511,050 | A | * | 4/1985 | Nicol | 215/219 |
| 4,548,157 | A | * | 10/1985 | Hevoyan | 116/308 |
| 4,705,182 | A | * | 11/1987 | Newel-Lewis | 215/230 |
| 4,749,093 | A | * | 6/1988 | Trick | 215/220 |
| 4,753,189 | A | * | 6/1988 | Mastman et al. | 116/308 |
| 4,890,741 | A | * | 1/1990 | Edelstein | 206/534 |
| 4,913,083 | A | * | 4/1990 | Valvo et al. | 116/308 |
| 4,976,351 | A | * | 12/1990 | Mangini et al. | 206/232 |
| 5,176,269 | A | * | 1/1993 | Herman | 215/228 |
| 5,246,123 | A | * | 9/1993 | Kramer et al. | 215/220 |
| 5,261,548 | A | * | 11/1993 | Barker et al. | 215/230 |
| 5,265,744 | A | * | 11/1993 | Duty et al. | 215/220 |
| 5,299,701 | A | * | 4/1994 | Barker et al. | 215/230 |
| 5,351,818 | A | * | 10/1994 | Daneshvar | 206/216 |
| 5,433,324 | A | * | 7/1995 | Leonard | 206/534 |
| 5,482,163 | A | * | 1/1996 | Hoffman | 206/534 |

(Continued)

*Primary Examiner* — Peter Macchiarolo
*Assistant Examiner* — Tania Courson
(74) *Attorney, Agent, or Firm* — Buskop Law Group, PC; Wendy Buskop

(57) ABSTRACT

The present embodiments relate to a dosage cap assembly for attaching to a standard prescription medicine container to aid in patient compliance with a dosage regimen. The dosage cap assembly can include a cap, time of day indicators, a medicine bottle, a lid with an outer member and an inner member, a ratcheting mechanism, and an indicator for pointing to the time of day indicators. Also disclosed is a method for tracking a last dosage that has been taken using a dosage cap assembly to aid in compliance of a dosage regimen.

1 Claim, 8 Drawing Sheets

(56) References Cited

U.S. PATENT DOCUMENTS

| | | | | | |
|---|---|---|---|---|---|
| 5,586,087 | A | * | 12/1996 | Silverson | 368/10 |
| 5,638,970 | A | * | 6/1997 | Garby et al. | 215/219 |
| 5,662,224 | A | | 9/1997 | Nogues | |
| 5,678,712 | A | * | 10/1997 | Rios | 215/220 |
| 5,720,392 | A | | 2/1998 | Price | |
| 5,732,836 | A | * | 3/1998 | Barker et al. | 215/230 |
| 5,934,492 | A | * | 8/1999 | Jones | 215/222 |
| 6,068,149 | A | * | 5/2000 | Telega | 215/230 |
| D426,461 | S | * | 6/2000 | Noble | D3/203.3 |
| 6,089,180 | A | * | 7/2000 | Nichols, Jr. | 116/309 |
| 6,259,654 | B1 | * | 7/2001 | de la Huerga | 368/10 |
| D447,621 | S | * | 9/2001 | Lehn | D3/203.1 |
| 6,324,123 | B1 | * | 11/2001 | Durso | 368/10 |
| D490,707 | S | * | 6/2004 | Mataya | D9/436 |
| 6,779,665 | B2 | * | 8/2004 | Bolanos | 206/569 |
| 6,805,072 | B1 | * | 10/2004 | DeSano | 116/308 |
| 7,061,831 | B2 | * | 6/2006 | De La Huerga | 368/10 |
| D550,571 | S | * | 9/2007 | Diaz | D9/719 |
| 7,314,022 | B2 | | 1/2008 | Sollaccio | |
| 7,556,151 | B2 | | 7/2009 | Seijas | |
| 7,565,979 | B1 | * | 7/2009 | Gibson | 206/570 |
| 7,621,231 | B2 | | 11/2009 | McNeely | |
| 7,661,384 | B2 | * | 2/2010 | Mataya | 116/311 |
| 7,665,611 | B2 | * | 2/2010 | Koch | 206/534 |
| 7,715,277 | B2 | * | 5/2010 | de la Huerga | 368/10 |
| 7,857,134 | B2 | * | 12/2010 | Koch | 206/534 |
| 7,886,909 | B2 | * | 2/2011 | Robinson | 206/534 |
| 7,926,661 | B2 | * | 4/2011 | Beeman | 206/572 |
| 8,006,846 | B2 | * | 8/2011 | Robertson | 206/570 |
| 2003/0192468 | A1 | * | 10/2003 | Goertzen | 116/309 |
| 2006/0124501 | A1 | * | 6/2006 | McNeely | 206/534 |
| 2007/0283878 | A1 | * | 12/2007 | Will | 116/308 |
| 2008/0257851 | A1 | * | 10/2008 | Vargas | 215/230 |

* cited by examiner

DOSAGE CAP ASSEMBLY FOR STANDARD PRESCRIPTION MEDICINE CONTAINERS

CROSS REFERENCE TO RELATED APPLICATIONS

The present application claims priority and benefit of co-pending U.S. Provisional Patent Application Ser. No. 61/258,724, filed on Nov. 6, 2009, entitled "DOSAGE CAP ASSEMBLY FOR STANDARD PRESCRIPTION MEDICINE CONTAINERS". This reference is hereby incorporated in its entirety.

FIELD

The present embodiments generally relate to a dosage cap assembly for attaching to medicine containers, vitamin containers, supplement containers, standard prescription medicine containers, and other such containers to aid in patient compliance with a dosage regimen.

BACKGROUND

A need exists for a dosage cap assembly for tracking the last time that a dosage of medication was taken and is in compliance with federal law requiring a tight closure of a cap or lid to a medicine vial or container to ensure drug potency.

A need exists for a very simple dosage cap assembly that can be installed on existing medicine dosage containers from a drug store or pharmacy.

A need exists for a dosage cap assembly that can be easily rotated to record the taking of pills by a person, thereby providing people who easily forget with a way of remembering which dosages they have taken.

A need exists for a dosage cap assembly that can be easily transported.

A need exists for a dosage cap assembly that is small, lightweight, compact, and can be traveled with such that the user is in compliance with state law and federal law.

A need exists for indicating to paramedics which dosages of which medications have been taken by a patient.

The present embodiments meet these needs.

BRIEF DESCRIPTION OF THE DRAWINGS

The detailed description will be better understood in conjunction with the accompanying drawings as follows.

Figure 1:
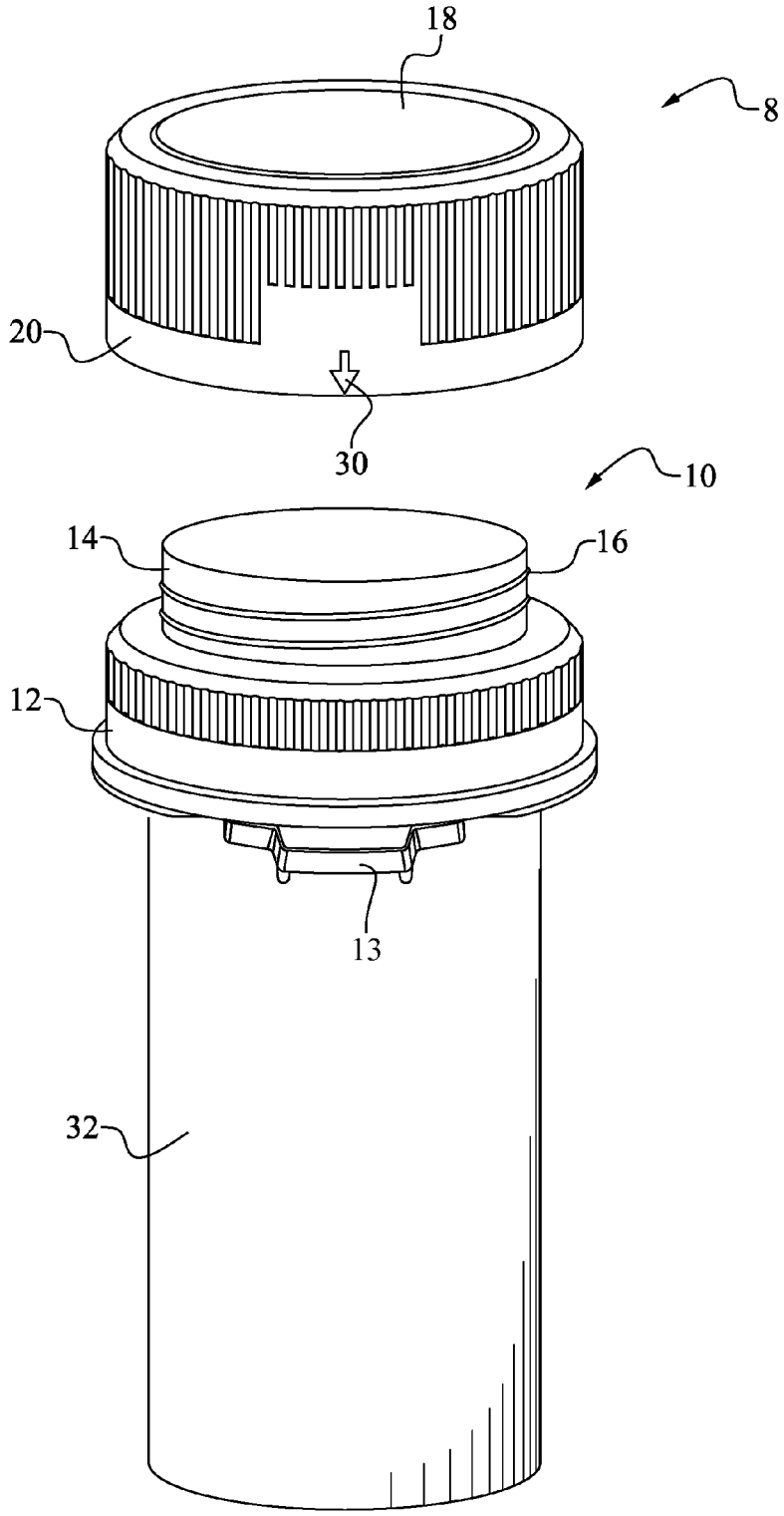
FIG. 1 is an exploded view of a dosage cap assembly.

The present embodiments are detailed below with reference to the listed Figures.

DETAILED DESCRIPTION OF THE EMBODIMENTS

Before explaining the present apparatus and method in detail, it is to be understood that the apparatus and method are not limited to the particular embodiments and that the apparatus and method can be practiced or carried out in various ways.

The present embodiments relate to a dosage cap assembly for attaching to containers to aid in patient compliance with a dosage regimen using solid dosage units of medicine such as pills, capsules and tablets.

One or more embodiment provide a simple solution for recording the last dosage that has been taken. A representative clock and an indicator arrow can be disposed within or on a top of a closure. The indicator arrow can be manually turned to point to a time indicator on the representative clock that represents the time that the last dosage was taken. Thus, a record can be produced of the time that the last dosage was taken. In the art, the label of a medication bottle will inform a user when to take the medication, however, embodiments of the present invention can tell the user what the user has already taken.

For example, a registered pharmacist can install the dosage cap assembly onto medicine containers to ensure patient compliance with a dosage regimen.

In one or more embodiments the container can be a medicine container, an over-the-counter vitamin container, an over-the-counter supplement container, an over-the-counter non-prescription medicine container, or a standard prescription medicine vial.

In one or more embodiments an already existing container and an already existing closure for containers can be adapted to form the dosage cap assembly.

The medicine containers can contain pills, capsules, tablets, vitamins, supplements, or other forms of medication.

Embodiments of the dosage cap assembly enable users to see the original label on the original medicine container while simultaneously monitoring the status of the pills taken. Users of the dosage cap assembly, such as patients, can travel with the original medicine container. Traveling with the original medicine container, rather than another pill planner, allows users to travel with all of the information associated with the medication, including the name of the medication, the prescribing doctor, the dosage, the risks and dangers of the medication, refill information, as well as other information associated with the medication.

Furthermore, a person traveling with a prescription medication without documentation or other information that the prescription is theirs can be arrested or can have the prescription medication confiscated by police or other authorities; as the law requires that only those with a valid prescription can be in possession of certain medications. A user with the dosage cap assembly can have the prescription vial with them, thereby having proof that the prescription is theirs and avoiding arrest or confiscation of their medication.

The problem with taking medication is that a user forgets that they have already taken a particular dosage of the medication, causing that user to take a particular dosage of medication twice.

The dosage cap assembly can prevent a user from taking too much medication which can lead to overdose, stroke, death, or some other complication.

Embodiments of the dosage cap assembly enable users to be reminded of the time the last dosage was taken. The dosage cap assembly can be helpful to users with faulty memories and to elderly users. For example, on prescription medicine containers, labels tell a patient when to take a dosage of the medication, however the label does not tell the patient when the patient took a dosage of the medication. The dosage cap assembly can provide patients, paramedics, and other persons with an indication of the last dosage the patient has taken, thereby avoiding overdose and other such dangers. The dosage cap assembly can allow paramedics responding to an emergency situation to be able to identify the dosages of medications taken and not taken by a particular patient, thereby aiding in their assistance to the patient.

One or more embodiments can reduce the number of hospital and nursing home admissions associated with patients forgetting which dosages of which medications they have taken thereby saving money, improving health, and saving lives.

Embodiments of the dosage cap assembly can be useful for users taking prescription narcotic based medications and over-the-counter medications including pain killers and allergy medicines, as these medications can be dangerous and can cause bodily organ damage and other complications if taken in large quantities.

The closure can be a cap, a lid, or another closure of a commercially available container from a pharmacy.

In one or more embodiments, the closure can include a bottom closure.

The bottom closure can include a top segment and a bottom segment which can be integrally connected.

The top segment can include top segment threads disposed on the top segment. In embodiments, the threads on the top segment can be clockwise threads or counter-clockwise threads.

The bottom segment can include threads disposed on an inside surface of the bottom segment for engagement with a container.

Time indicators can be disposed on the bottom segment. For example, the time indicators can be disposed about a side perimeter of the bottom segment.

The time indicators can indicate times of day in any increment of time. For example, the time of day indicators can provide time indications in one hour increments, in two hour increments, or in daily increments. The time of day indicators can be imprinted on the closure.

In one or more embodiments the time indicators can include: a 6 am indicator, an 8 am indicator, a 10 am indicator, 12 noon indicator, a 2 pm indicator, a 4 pm indicator, a 6 pm indicator, an 8 pm indicator, a bed indicator, or combinations thereof.

The bed indicator can indicate an eight hour sleep period, thereby forming a 24 hour clock.

The time indicators can include: a Sunday indicator, a Monday indicator, a Tuesday indicator, a Wednesday indicator, a Thursday indicator, a Friday indicator, a Saturday indicator, or combinations thereof.

In one or more embodiments the closure can include a top closure engaged over the bottom closure.

The top closure can include an inner member with inner member threads formed on an inner portion of the inner member. The inner member threads can be threadably engaged with the top segment threads, thereby attaching the top closure to the bottom closure. In one or more embodiments, the thread on the inner portion can be clockwise threads or counter-clockwise threads. The inner member can be disposed within an inner portion of an outer member.

The top closure can include an outer member with a side portion. The outer member can be rotatably disposed about the inner member.

A ratcheting mechanism can be integral with the top closure. The ratcheting mechanism can include an inner member portion and an outer member portion. When a pressure is applied to the outer member, the outer member portion of the ratcheting mechanism can engage with the inner member portion of the ratcheting mechanism, thereby preventing the outer member from rotating in one direction with respect to the inner member.

The ratcheting mechanism can be disposed between the inner member and the outer member. The ratcheting mechanism can prevent the outer member from rotating counter-clockwise with respect to the inner member, while allowing the outer member to rotate clockwise with respect to the inner member. In embodiments, the ratcheting mechanism can prevent the outer member from rotating clockwise with respect to the inner member, while allowing the outer member to rotate counter-clockwise with respect to the inner member.

The ratcheting mechanism can provide a plurality of stopping points along the rotation of the outer member about the inner member. For example, inner teeth can be disposed on the inner member and outer teeth can be disposed on the outer member. The outer teeth can engage the inner teeth for holding the outer member in position about the inner member. The outer teeth and the inner teeth can be angled such that the outer teeth can only move in one direction with respect to the inner teeth. Each point wherein the outer teeth reside between the inner teeth can be a stopping point.

The ratcheting mechanism can be arranged such that each stopping point, which stops the rotation of the outer member about the inner member, corresponds to a time indicator. The above described ratcheting mechanism is for illustrative purposes only. The dosage cap assembly can include other ratcheting mechanisms.

An indicator can be disposed on the side portion of the outer member. A user can rotate the outer member about the inner member for pointing the indicator to the time indicators in series, thereby allowing a user to point the indicator to a time indicator associated with a last dosage that has been taken.

For example, as the outer member is rotated about the inner member, the indicator can rotate as well and can move from pointing to a time indicator associated with a previous dosage taken to pointing to a time indicator associated with the last pill taken. Therefore, upon taking each dosage, a user can point the indicator to a time indicator associated with the last pill taken, such that the next time the user looks at the medicine vial or medicine container with the dosage cap assembly the user will know that the user has already taken the last pill taken as indicated by the dosage cap assembly.

The top closure can be a universal closure such that the to top closure can engage and/or fit over a top portion of a commercially available bottom closure of a vial or container.

The outer member can include a top portion and a side portion extending from the top portion. The outer member can be rotatably engaged with the inner member. The outer member can therefore rotate about the inner member.

Child-resistant features of a medicine vial or medicine container can remain functional when the dosage cap assembly is installed on the medicine vial or medicine container.

In operation, a user can engage a bottom closure over a vial or container. The user can then engage a top closure over the bottom closure. The user can rotate the top closure about the bottom closure to point the indicator to the time indicator corresponding to the last dosage of the medication that the user has taken. Each time the user takes a dosage of medication, the user can rotate the top closure about the bottom closure until the indicator points to the time indicator that corresponds to the most recent dosage of medication taken by the user. The user can therefore keep track of which dosages the user has taken.

The dosage cap assembly can thereby record that a last pill has been taken at the time indicated by the time indicator.

In one or more embodiments, the closure can be made from a metal. The time indicators and the indicator can be formed in the metal. The metal can be sterling silver, gold, platinum, a precious metal, or another metal.

The closure can be made from a polymeric material resistant to deformation in the presence of heat.

One or more embodiments can include a closure for engaging directly over a vial or container. The enclosure can include an inner member and an outer member.

The outer member can be rotatably disposed about the inner member. The outer member can be formed as a ring shaped member.

A ratcheting mechanism can be integral with the closure. The ratcheting mechanism can include an inner member portion and an outer member portion. When a pressure is applied to the outer member, the outer member portion of the ratcheting mechanism can engage with the inner member portion of the ratcheting mechanism, thereby preventing the outer member from rotating in one direction with respect to the inner member.

A clock face can be disposed on a top surface of the inner member. Time indicators can be disposed on the clock face indicating times of day. The clock face can be white. The clock face can be a simple 24 hour clock face.

The top surface of the inner member can be viewable, as the inner member can be disposed within the circumference of the ring formed by the outer member.

An indicator, which can be an arrow, can be disposed on the outer member for pointing to the time indicators in series, thereby allowing a user to point the indicator arrow to a time indicator associated with a last dosage that has been taken.

The indicator can be formed on a circumference of the outer member for pointing to the time indicators when the outer member is rotated about the inner member.

A user can rotate the outer member to point the indicator to a correct time indicator, thereby recording that a last pill has been taken at the time indicated by the time indicator.

In one or more embodiments, the closure can engage directly over a medicine vial or medicine container. The closure can be a single closure rather than a two-part closure having a top closure and a bottom closure.

In one or more embodiments, the time indicators can be indicia formed on a top of the top closure indicating the times of day. The times of day can be indicated in various different time increments such as one hour increments, two hour increments, or daily increments. The indicia can be formed as black letters and/or black numerals.

In operation, a user can engage the closure over a vial or container. The user can rotate the outer member of the closure about the inner member of the closure to point the indicator to the time indicator that corresponds to the last dosage of the medication that the user has taken. Each time the user takes a dosage of medication, the user can rotate the outer member about the inner member until the indicator points to the time indicator that corresponds to the most recent dosage of medication taken by the user.

One or more embodiments can include a travel kit for containing one or more vials or containers. The travel kit can be a plastic container, which can be a clear plastic container. The travel kit can of a size such that standard prescription medicine containers disposed within the travel kit will remain in place without sliding about, falling over, or otherwise moving from a position that the standard prescription medicine vial is placed at.

The travel kit can allow a user to store and travel with the user's prescription medicines within the original prescription containers with the labels printed thereon. The travel kit can allow a user to store and travel with health information cards including information regarding diabetes, drug allergies, implants, pacemakers, transplants, medical insurance, the user's primary care physician, and the user's prescribing physician.

In one or more embodiments the dosage cap assembly can include a container and a closure engaged over the container.

The closure can include time indicators disposed on a side surface of the closure.

An indicator can be disposed on a side of the container for pointing to the time indicators in series, thereby allowing a user to point the indicator to a time indicator associated with a last dosage that has been taken.

In one or more embodiments, an open indicator can be disposed on the side surface of the closure, wherein when the open indicator is aligned with the indicator the closure can be attached or detached from the container.

In one or more embodiments, the time indicators can be disposed on a vial or container and the indicator can be disposed on a closure engaged over the vial or container such that a user can rotate the closure until the indicator points to a correct time indicator.

One or more embodiments relate to a method for tracking a last dosage that has been taken using a dosage cap assembly to aid in compliance of a dosage regimen using solid dosage units of medicine such as pills, capsules, or tablets.

The method can include engaging a bottom closure of a dosage cap assembly over a prescription medicine vile.

The method can include engaging a top closure of the dosage cap assembly over the bottom closure.

The method can include pointing the indicator to a time indicator associated with a last dosage that has been taken by rotating the outer member about the inner member, thereby allowing a user track the last dosage that has been taken in a dosage regimen.

In one or more embodiments, the method can include engaging a dosage cap assembly over a container.

In one or more embodiments, the method can include engaging a closure over a container. The method can include pointing the indicator to a time indicator associated with a last dosage that has been taken by rotating the closure about the container, thereby allowing a user track the last dosage that has been taken in a dosage regimen.

Turning now to the Figures, FIG. 1 shows an exploded view of an embodiment of the dosage cap assembly.

A bottom closure 10 can include a top segment 14 and a bottom segment 12. The top segment 14 can have top segment threads 16.

A top closure 8 can have a top 18, a side 20, and an indicator 30 disposed on the side. The indicator 30 can include an arrow.

The bottom closure 10 can be engaged over a container 32, here shown as a prescription medicine vial.

The embodiment depicted is child resistant, wherein lever 13 can be held down, such as with a user's thumb, and then the bottom closure 10 can be turned counter clockwise about the container 32 to remove the bottom closure from the container.

In one or more embodiments, the container 32 and the bottom closure 10 can be a standard available prescription medicine vial and a standard available prescription medicine vial closure.

The top closure 8 with the indicator 30 can be disposed over the standard bottom closure 10, thereby forming the dosage cap assembly.

Figure 2:
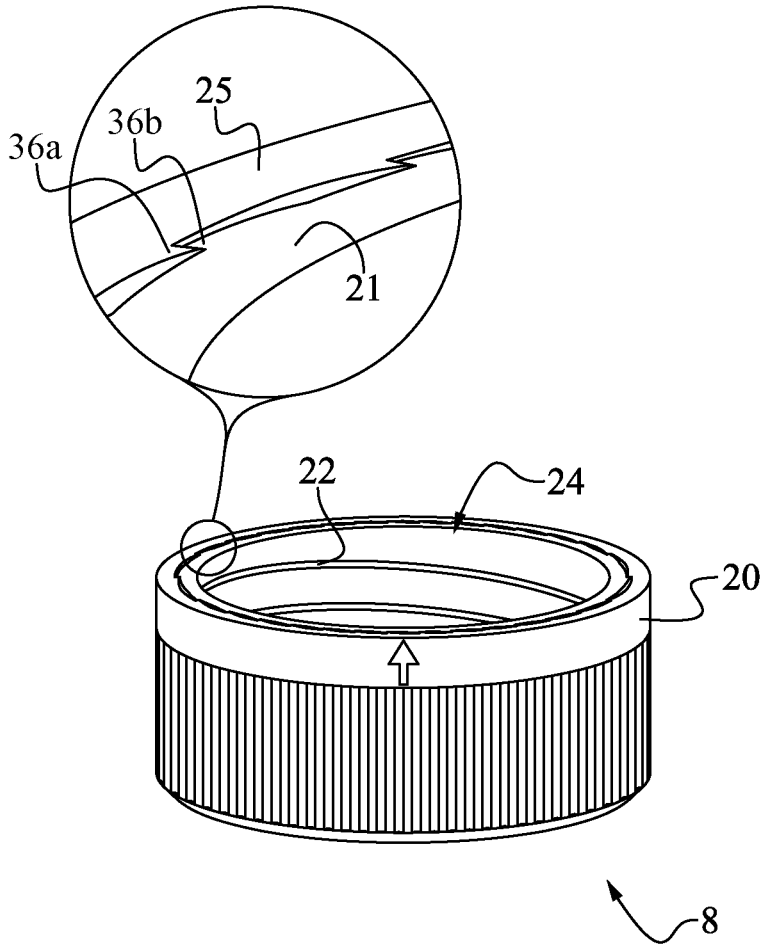
FIG. 2 is a perspective view of a top closure.

FIG. 2 shows an embodiment of the top closure 8. The top closure 8 can have an inner member 21. Inner threads 22 can be disposed on an inner portion 24 of the inner member 21.

The top closure 8 can have an outer member 25 which can be rotatably disposed about the inner member 21.

A ratcheting mechanism can be disposed between the inner member 21 and the outer member 25, or formed integrally with the inner member and the outer member.

The ratcheting mechanism can include an outer member ratcheting portion 36*a* and an inner member ratcheting portion 36*b*.

Figure 3:
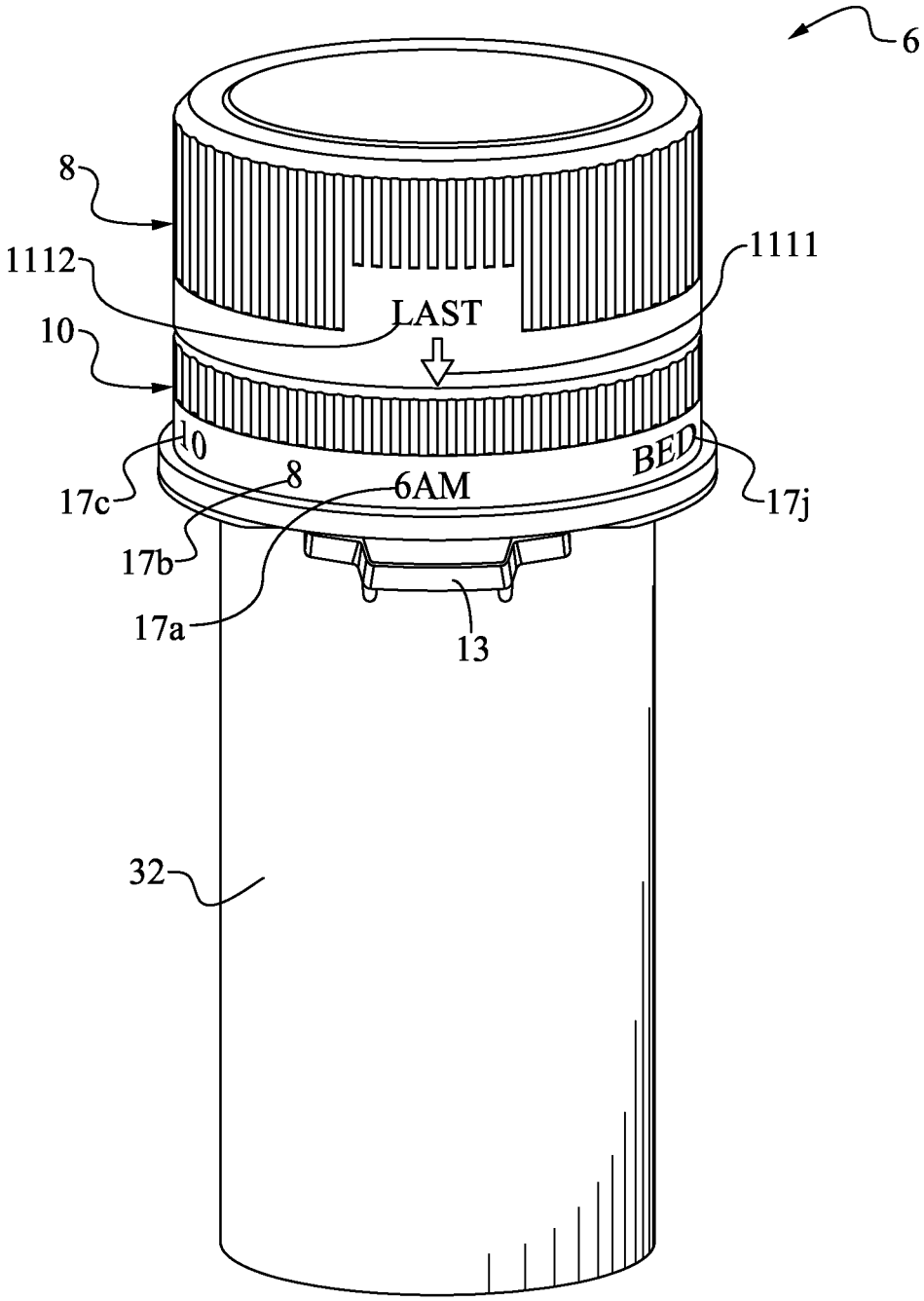
FIG. 3 is a view of an assembled dosage cap assembly.

FIG. 3 depicts an assembled view of an embodiment of the dosage cap assembly 6.

The top closure 8 can be engaged with the bottom closure 10, which can in-turn be engaged with the prescription medicine vial 32.

Time indicators 17*a*, 17*b*, 17*c*, and 17*j* can be disposed on the bottom segment of the bottom closure 10.

Time indicator 17*a* is shown as "6 AM", indicating a time of 6:00 am. Time of day indicator 17*b* is shown as an "8", indicating at time of 8:00 am. Time of day indicator 17*c* is shown as a "10", indicating a time of 10:00 am. Time of day indicator 17*j* is shown as "BED", indicating "bedtime".

The time indicators can include other numerals or symbols indicating other times of day. For example, the following indicators can be sequentially disposed about the bottom segment of the bottom closure 10 in a 360 degree clockwise orientation: "B" indicating bedtime, "8" indicating 8:00 pm, "6" indicating 6:00 pm, "4" indicating 4:00 pm, "2" indicating 2:00 pm, "12" indicating 12:00 noon, "10" indicating 10:00 am, "8" indicating 8:00 am, and "6" indicating 6:00 am.

The time indicators can be imprinted onto the standard bottom closure 10. The top closure 8, which can be referred to as a top indicator, can have an indicator arrow 1111, The word "LAST" 1112 can be printed on the top closure 8 and aligned with the indicator arrow 1111.

Figure 4:
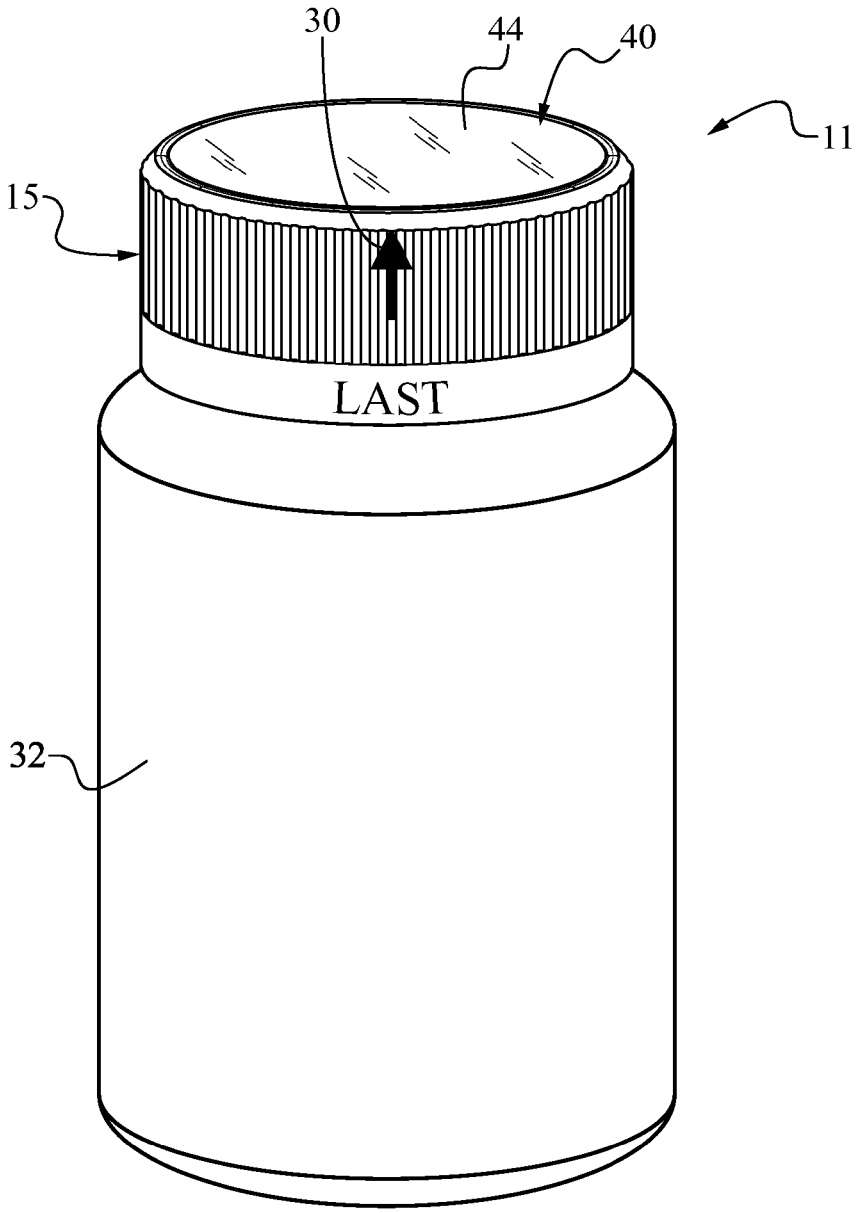
FIG. 4 is a view of another embodiment of an assembled dosage cap assembly.

FIG. 4 shows an assembled view of another embodiment of the dosage cap assembly.

A closure 11 can be engaged with the container 32. The closure 11 can be formed of an outer member 15 and an inner member 40. The outer member 15 can be formed as a ring and can be rotatably disposed about the inner member 40. A ratcheting mechanism, such as the one depicted in FIG. 2, can provide engagement between the outer member 15 and the inner member 40.

An indicator 30 can be disposed along a side or a rim of the outer member 15. A top surface 44 of the inner member can be seen.

The embodiment depicted is child resistant, wherein the closure 11 can be pushed down and the outer member portion of the ratcheting member can be engaged with the inner member portion of the ratcheting mechanism while simultaneously turning the closure 11 about the container 32 to remove the closure from the container.

Figure 5:
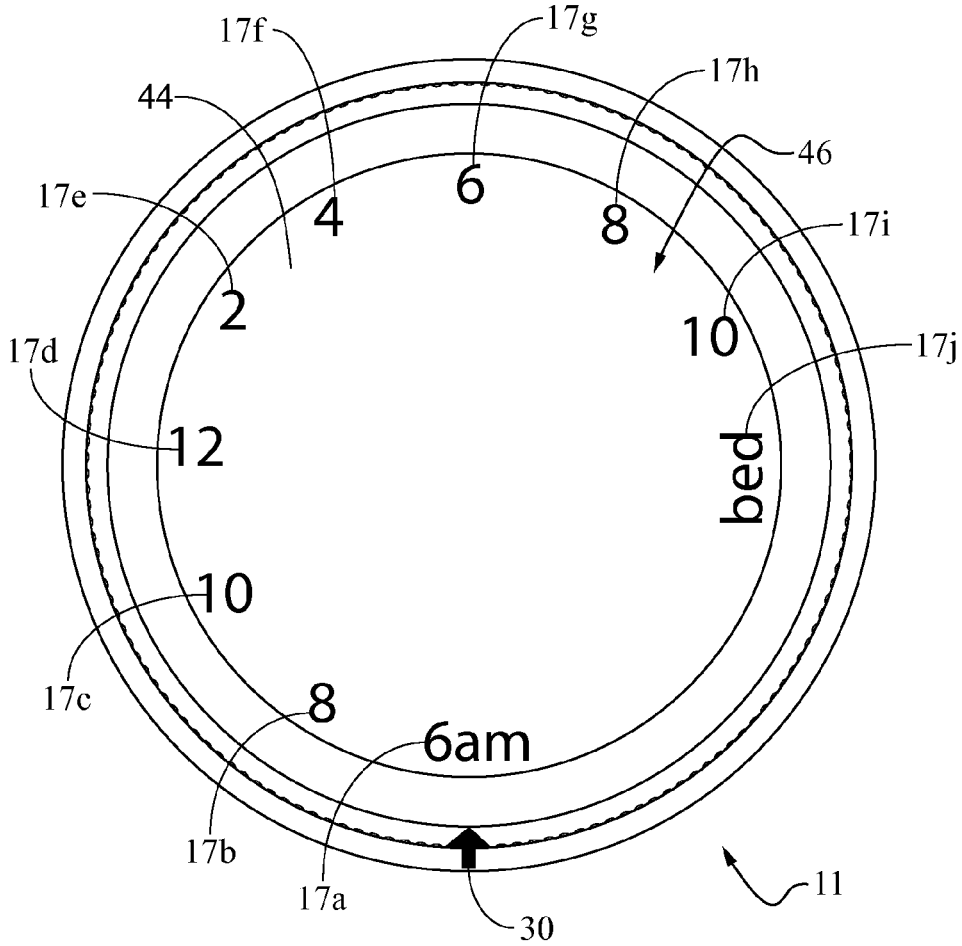
FIG. 5 is a top view of a clock face.

FIG. 5 shows a top perspective view of an embodiment of the closure 11 shown in FIG. 4.

A clock face 46 can be disposed on the top surface 44. The indicator 30 can point to a time on the clock face. The indicator 30 can be rotated as part of the outer member to point to other times on the clock face 46. The indicator 30 can be printed on the outer member.

The clock face 46 can include: time indicator 17*a*, shown as "6 am", indicating a time of 6:00 am; time indicator 17*b*, shown as an "8", indicating a time of 8:00 am; time indicator 17*c*, shown as a "10", indicating a time of 10:00 am; time indicator 17*d*, shown as a "12", indicating a time of 12:00 noon; time indicator 17*e*, shown as a "2", indicating a time of 2:00 pm; time indicator 17*f*, shown as a "4", indicating a time of 4:00 pm; time indicator 17*g*, shown as a "6", indicating a time of 6:00 pm; time indicator 17*h*, shown as an "8", indicating a time of 8:00 pm; time indicator 17*i*, shown as a "10", indicating a time of 10:00 pm; and time indicator 17*j*, shown as "bed", indicating bedtime.

Other numerals or symbols can be disposed on the time indicators indicating other times of day.

Figure 6:
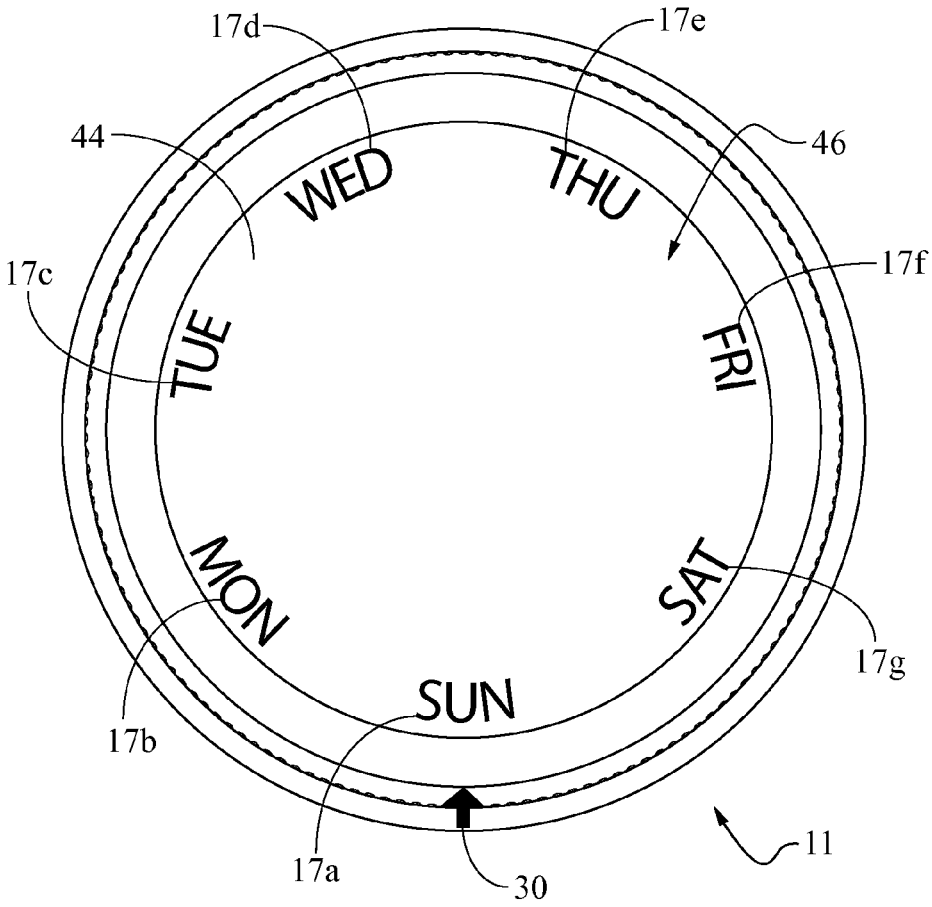
FIG. 6 is a top view of another clock face.

FIG. 6 shows another embodiment of the clock face 46 shown in FIG. 5 indicating time in daily increments.

The clock face 46 can include: time indicator 17*a*, shown as "SUN", indicating Sunday; time indicator 17*b*, shown as "MON", indicating Monday; time indicator 17*c*, shown as "TUE", indicating Tuesday; time indicator 17*d*, shown as "WED", indicating Wednesday; time indicator 17*e*, shown as "THU", indicating Thursday; time indicator 17*f*, shown as "FRI", indicating Friday; and time indicator 17*g*, shown as "SAT", indicating Saturday.

Figure 7:
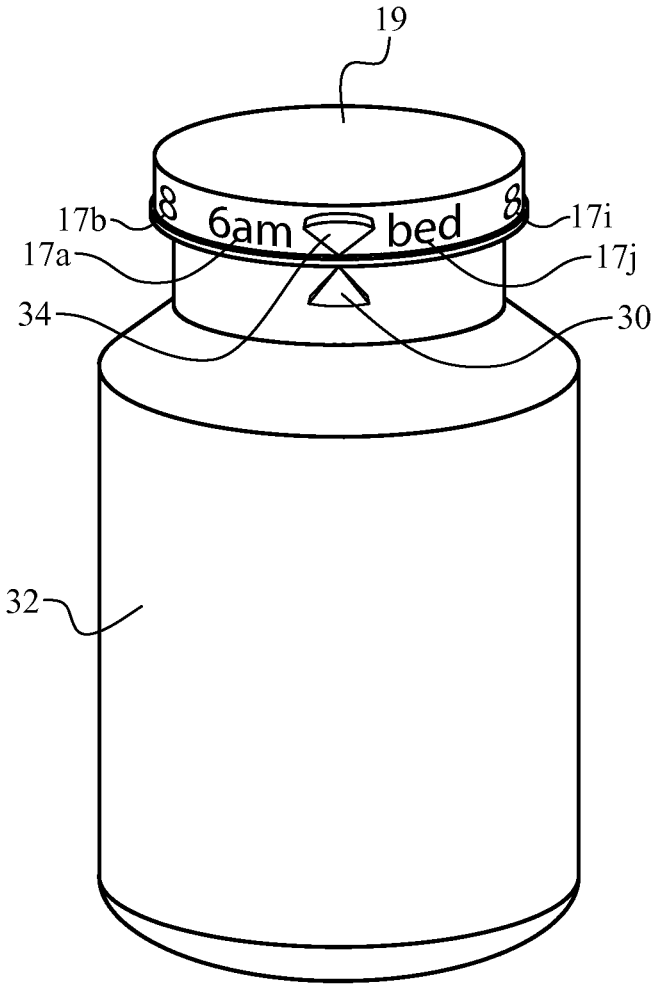
FIG. 7 is a top view of another embodiment of the dosage cap assembly.

FIG. 7 shows another embodiment of the dosage cap assembly.

A closure 19 can be engaged over a container 32. Time indicators 17*a*, 17*b*, 17*i*, and 17*j* can be disposed on the closure 19.

Time indicator 17*a* is shown as "6 am", indicating a time of 6:00 am. Time indicator 17*b* is shown as "8", indicating a time of 8:00 am. Time indicator 17*i* is shown as "8" indicating a time of 8:00 pm. Time indicator 17*j* is shown as "bed" indicating bedtime.

An indicator 30 can be disposed on a side of the container 32 for pointing to the time indicators in series, thereby allowing a user to point the indicator to a time indicator associated with a last dosage that has been taken.

An open indicator 34 can be disposed on the side surface of the closure 19. The open indicator 34 can be aligned with the indicator 30 for attaching or detaching the closure 19 from the container 32.

Figure 8:
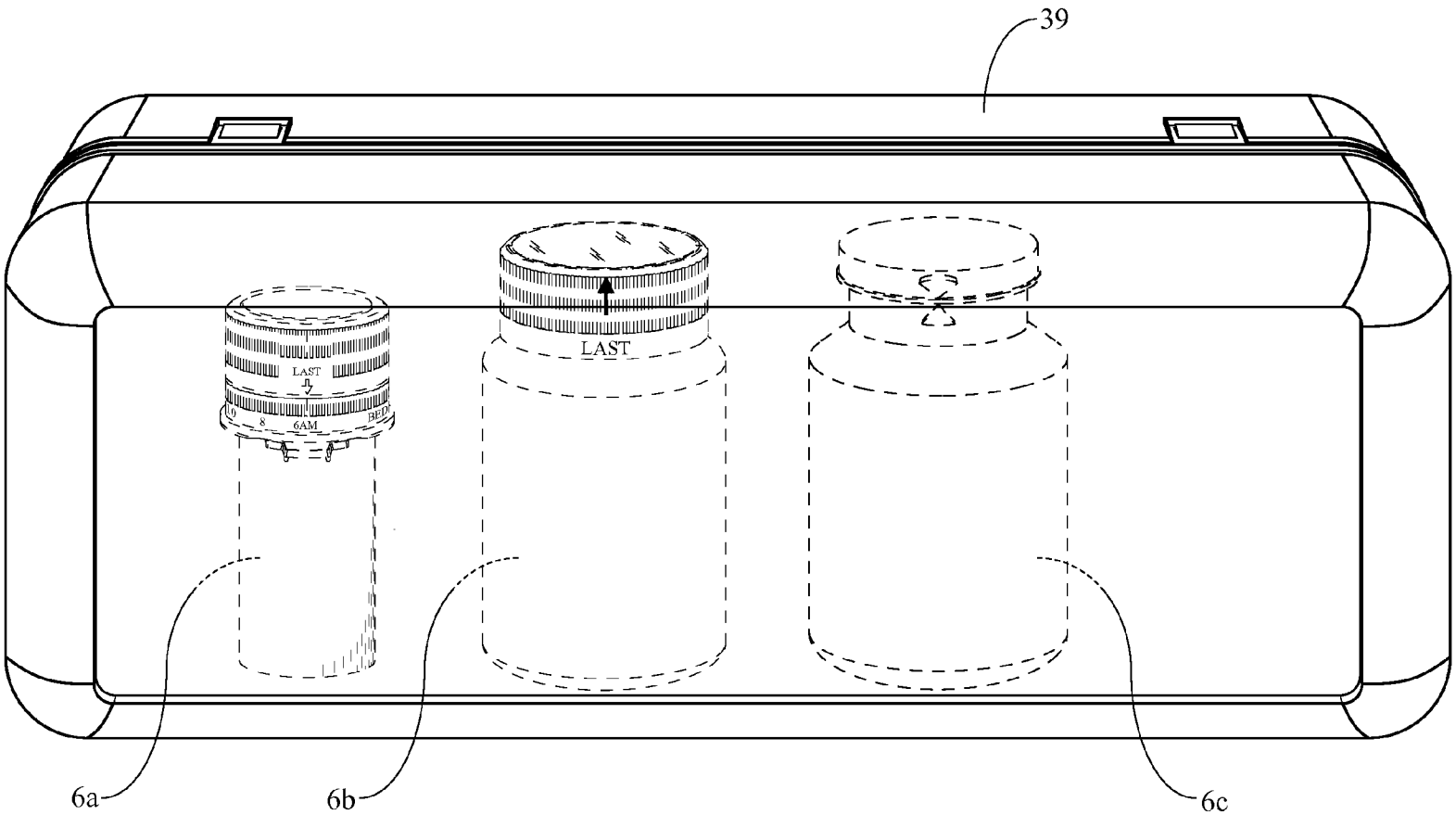
FIG. 8 is a view of a clear plastic kit.

FIG. 8 shows an embodiment of a plurality of dosage cap assemblies 6*a*, 6*b*, and 6*c* disposed within a clear plastic travel kit 39.

While these embodiments have been described with emphasis on the embodiments, it should be understood that within the scope of the appended claims, the embodiments might be practiced other than as specifically described herein.

What is claimed is:

1. A dosage cap assembly for attaching to a standard prescription medicine container to aid in compliance of a dosage regimen using solid dosage units of medicine such as pills, capsules, or tablets, the dosage cap assembly consisting:

a. a bottom closure, wherein the bottom closure has a bottom segment configured to connect directly to the standard prescription medicine container and a top segment, said top segment having threads, wherein a twenty-four hour clock is located on the outer periphery of the bottom segment; and b. a top indicator comprising a side and a top, wherein an indicator arrow is located on an outer surface of the side, wherein the top indicator has last printed thereon and aligned with the indicator arrow; and wherein an inner surface of the side is connected directly to the top segment, wherein a distal end of the side opposite the top is touching a top surface of the bottom segment, and wherein the top indicator is rotatable about the bottom closure, wherein said bottom closure encloses the standard prescription medicine container.

* * * * *